US006874466B2

(12) United States Patent
Shibata et al.

(10) Patent No.: US 6,874,466 B2
(45) Date of Patent: Apr. 5, 2005

(54) INTAKE VALVE DEVICE

(75) Inventors: Yukihiro Shibata, Aichi-ken (JP); Toru Sakurai, Aichi-ken (JP)

(73) Assignee: Aisan Kogyo Kabushiki Kaisha, Aichen-ken (JP)

( * ) Notice: Subject to any disclaimer, the term of this patent is extended or adjusted under 35 U.S.C. 154(b) by 0 days.

(21) Appl. No.: 10/844,587

(22) Filed: May 13, 2004

(65) Prior Publication Data

US 2005/0000488 A1 Jan. 6, 2005

(30) Foreign Application Priority Data

May 14, 2003 (JP) ..... 2003-136017

(51) Int. Cl.[7] ..... F02D 9/10
(52) U.S. Cl. ..... 123/337; 251/305; 251/308
(58) Field of Search ..... 123/337; 251/305, 251/308

(56) References Cited

U.S. PATENT DOCUMENTS 5,794,591 A * 8/1998 Kalebjian et al. ..... 123/337
6,352,241 B1 * 3/2002 Hannewald et al. ..... 251/305
6,494,466 B1 * 12/2002 Hartman et al. ..... 251/305
6,553,963 B1 * 4/2003 Noble ..... 123/337
2003/0052294 A1 * 3/2003 Moore et al. ..... 251/305

FOREIGN PATENT DOCUMENTS

JP 11-101137 4/1999

* cited by examiner

*Primary Examiner*—Erick Solis
(74) *Attorney, Agent, or Firm*—Dennison, Schultz, Dougherty & MacDonald

(57) ABSTRACT

An intake valve device includes a throttle body defining a bore for the flow of intake air. A throttle shaft is rotatably mounted to the throttle body. A slit is formed in the throttle shaft in a diametrical direction and extends throughout the diameter of the throttle shaft. The slit has opposing end walls along the rotational axis of the throttle shaft. A throttle valve is inserted into the slit of the throttle shaft and fixed in position relative to the throttle shaft. Possible intake air leakage channels are defined between the outer periphery of the throttle valve and the end walls of the slit. At least one restriction portion is formed on the throttle valve so as to extend into at least one of the possible leakage channels in order to narrow the possible leakage channel and reduce or inhibit the leakage of intake air.

14 Claims, 6 Drawing Sheets

INTAKE VALVE DEVICE

This application claims priority to Japanese patent application serial number 2003-136017, the contents of which are incorporated herein by reference.

BACKGROUND OF THE INVENTION

1. Field of the Invention

The present invention relates to intake valve devices for controlling the flow rate of intake air that may be supplied to an engine, such as an internal combustion engine.

2. Description of the Related Art

A known intake valve device is shown in FIG. 8 and generally comprises a throttle body 101, a throttle shaft 106, and a throttle valve 130. A substantially cylindrical bore 103 is formed within the throttle body 101 so that intake air flows through the bore 103. The throttle shaft 106 is rotatably mounted in the throttle body 101 and extends across the bore 103. A slit 107 is formed so as to extend through the throttle shaft 106 in a diametrical direction. The slit 107 is elongated in an axial direction of the throttle shaft 106. The throttle valve 130 has a substantially circular configuration. The throttle valve 130 is inserted into the slit 107 of the throttle shaft 106 and is secured thereto via screws 114. As the throttle shaft 107 rotates, the throttle valve 130 rotates within the bore 103, so that the bore 103 is opened or closed by the throttle valve 130. This type of intake valve device is disclosed in Japanese Laid-Open Patent publication No. 11-101137.

In general, in order to form the slit 107 within the throttle shaft 106, a rotary tool such as a disk-shaped rotary cutter 140 (shown in FIG. 10) is rotatably driven. The rotary cutter 140 is moved toward and away from the throttle shaft 106 in the diametrical direction of the throttle shaft 106 (perpendicular to the central axis of the throttle shaft 106) as indicated by arrows Y1 in FIG. 10. The rotary cutter 140 has a diameter larger than a diameter of the throttle valve 130 (indicated by the two-dashed line in FIG. 10). Thus, the rotary cutter 140 is moved toward the throttle shaft 106 (downward as viewed in FIG. 10) in order to cut the throttle shaft 106, forming the slit 107 so as to have a predetermined width (length in right and left directions as viewed in FIG. 10). After which, the rotary cutter 140 is moved away from the throttle shaft 106 (upward direction as viewed in FIG. 10). This method results in two inclined, or tapered in the downward direction, end walls 107*a* of the slit 107, spaced apart from each other in the longitudinal direction (in the axial direction of the throttle shaft 107). In addition, a tolerance may be given to the slit 107 in order to take into account the possible variations in the size of the disk 130 or the slit 107 due to differences in machining operations. The tolerance may increase the distance between the end walls 107*a*.

Therefore, according to the design of the publication, it is inevitable that channels "A", i.e., clearances, as shown in FIG. 9 are more or less formed between the circumferential edge surface of the disk 130 and the end walls 107*a* of the slit 107. When the throttle valve 130 is in a fully closed position, the channels "A" may serve as intake air bypass channels causing leakage of the intake air, as indicated by an arrow Y in FIG. 9. The flow rate of possible leaking intake air may be increased over a situation where either no channels "A" or smaller channels "A" exist. The leaking intake air may not present a problem when the throttle valve 130 is in the open position, because the intake air may flow more readily through the open bore 103.

SUMMARY OF THE INVENTION

It is accordingly an object of the present invention to teach improved intake valve devices that can reduce the flow rate of possible leaking intake air when a throttle valve is in a fully closed position.

According to one aspect of the present teachings, intake valve devices are taught that include a throttle body defining a bore allowing the flow of intake air. A throttle shaft is rotatably mounted to the throttle body. A slit is formed in the throttle shaft in a diametrical direction (passing through the central axis of the throttle shaft) and extends along the throttle shaft (in the longitudinal direction) for least as wide as the bore of the throttle body. The slit extends through the diameter of the throttle shaft for a region at least as wide as the bore of the throttle body. The slit has opposing end walls in the throttle shaft (in the longitudinal direction) on either side of the bore of the throttle body. A throttle valve is inserted into the slit of the throttle shaft and is fixed in position relative to the throttle shaft, such that at least one possible leakage channel may be defined between the outer periphery of the throttle valve and an end wall of the slit. At least one restriction portion is formed on the throttle valve so as to extend into at least one of the possible leakage channels in order to narrow or restrict the possible leakage channel.

Because the restriction portion narrows the possible leakage channel, the leakage of intake air may be reduced. The restriction portion results in less intake air bypassing the throttle valve. Therefore, the problem of intake air leakage when the throttle valve is in a fully closed position can be inhibited or resolved.

In another aspect of the present teachings, the at least one restriction portion is configured as a projection that extends from the outer periphery of the throttle valve. Therefore, the restriction portion can be formed at the same time that the throttle valve is formed. For example, a throttle valve with a projection can be formed by a flat plate punching operation of a metal material or by an injection molding process using a resin material.

In another aspect of the present teachings, the throttle valve is inserted into the slit in a direction perpendicular to the rotational axis of the throttle shaft.

In another aspect of the present teachings, the at least one restriction portion is configured so as to not interfere with an inner wall of the bore. Therefore, the configuration helps to ensure the free movement of the throttle valve in performing a flow control function.

In another aspect of the present teachings, the at least one restriction portion is configured to substantially contact with the corresponding end wall of the slit. Therefore, the configuration can reliably prevent or minimize the leakage of the intake air through the possible leakage channel.

In another aspect of the present teachings, at least one pair of restriction portions is formed. The pair of restrictions is located on at least one side of the throttle valve (directly opposing an end wall of the slit).

In another aspect of the present teachings, a pair of restriction portions is configured to be symmetrical with respect to a diametrical line of the throttle valve that coincides with the rotational axis of the throttle shaft. The symmetry is present about the diametrical line when the throttle valve is fixed to the throttle shaft via the fixing device. With this arrangement, leakage of the intake air through the possible leakage channels can be prevented or minimized by at least one of the restriction portions. The reduction in the leakage of intake air is possible regardless of whether the throttle valve is inserted into the slit in one orientation or 180° from that orientation. Therefore, the symmetry of the restriction portions allows the assembling operation of the throttle valve to be more readily facilitated and less prone to error in the assembly orientation of the throttle valve.

Preferably, the pair of restriction portions is connected to each other via a linear edge that extends substantially perpendicular to the diametrical line of the throttle valve. The restriction portions may be formed as corners on both ends of the linear edge. As a result, the restriction portions may be easily formed and may be improved in strength.

DETAILED DESCRIPTION OF THE INVENTION

Each of the additional features and teachings disclosed above and below may be utilized separately or in conjunction with other features and teachings to provide improved intake valve devices and methods of using such improved intake valve devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
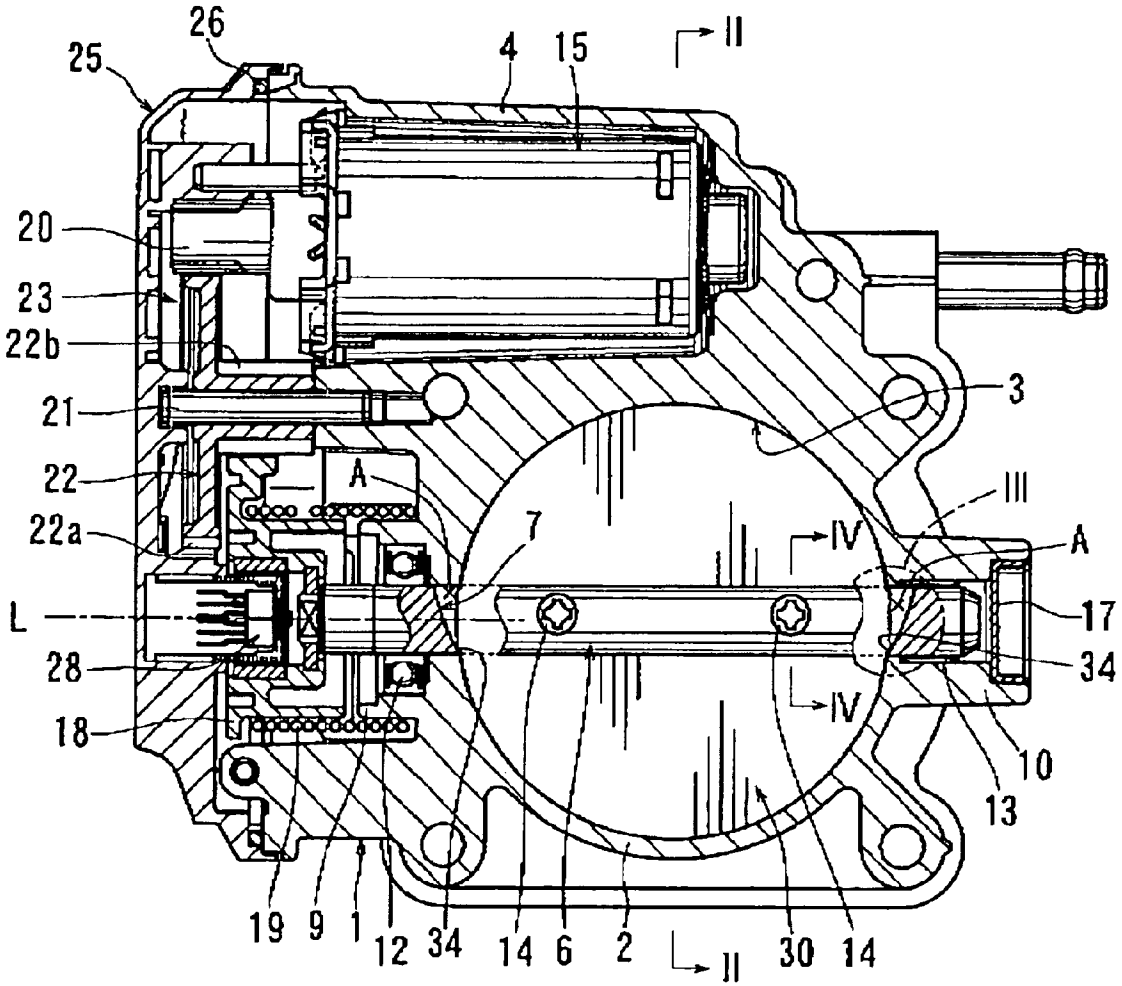
FIG. 1 is a sectional plan view of a representative intake valve device.
Figure 2:
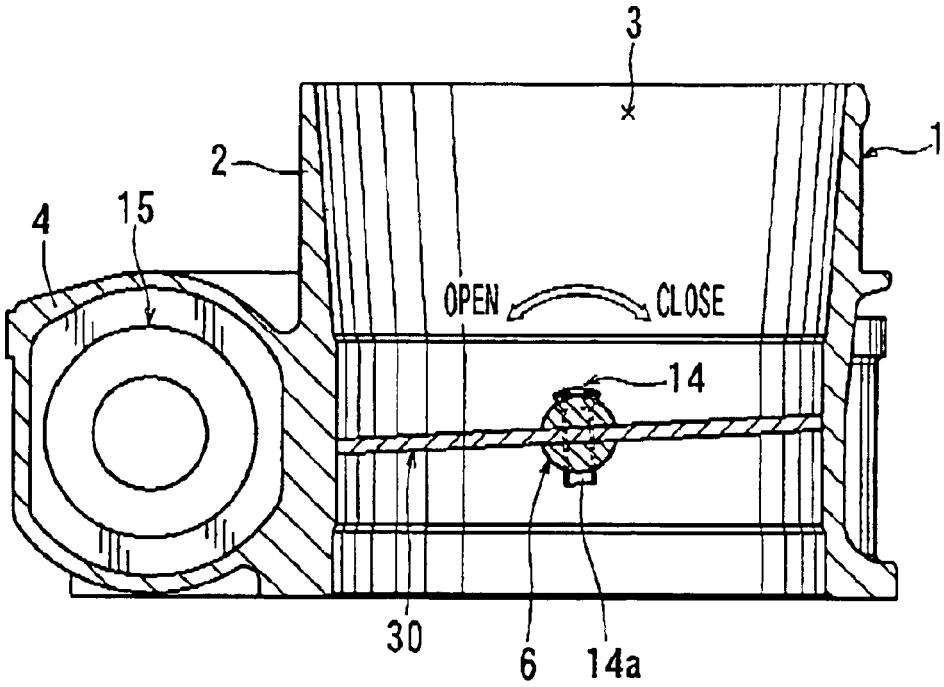
FIG. 2 is a cross sectional view taken along line II—II in FIG. 1.

A representative embodiment will now be described with reference to the drawings. A representative intake valve device is shown in FIGS. 1 and 2. The representative embodiment is configured as an electronically controlled intake valve device. The intake valve device mainly comprises a throttle body 1 that is made of resin or metal, for example an aluminum alloy. The throttle body 1 includes a substantially cylindrical portion 2 and a motor housing portion 4, that are formed integrally with each other. A cylindrical bore 3 is defined within the cylindrical portion 2 and extends vertically there through as viewed in FIG. 2. An air cleaner and an intake manifold (not shown) may be respectively connected to the upstream side and the downstream side of the cylindrical portion 2.

As shown in FIG. 1, a metal throttle shaft 6 is mounted to the cylindrical portion 2 and extends across the bore 3 in a diametrical direction of the bore. Left and right support portions, 9 and 10, via left and right bearings, 12 and 13, rotatably support both ends of the throttle shaft 6. Preferably, the left bearing 12 is configured as a radial bearing, such as a ball bearing, and the right bearing 13 is configured as a thrust bearing.

As shown in FIG. 1, a throttle valve 30 is secured to the throttle shaft 6 via headed screws 14, as a fixing device, so that the throttle valve 30 can incrementally open and close the bore 3 as the throttle shaft 6 rotates. More specifically, a motor 15, coupled to the throttle shaft 6, rotatably drives the throttle valve 30. Controlling the degree of opening of the throttle valve 30 can control the flow rate of intake air through the bore 3. FIG. 2 shows the throttle valve 30 in a fully closed position. The bore 3 is opened as the throttle valve 30 rotates in a counterclockwise direction ("OPEN" direction indicated in FIG. 2) from the fully closed position shown in FIG. 2. The mounting structure of the throttle valve 30 to the throttle shaft 6 will be explained later.

As shown in FIG. 1, the right support portion 10 is configured as a tubular portion having an open end. A plug 17 is inserted into the open end of the right support portion 10 in order to seal the inner space of the right support portion 10 from the outside environment. A throttle gear 18, configured as a sector gear, is mounted to the left end of the throttle shaft 6 that extends through and beyond the left support portion 9. The throttle gear 18 is fixed in position relative to the rotational movement of the throttle shaft 6. A torsion spring 19 has one end attached to the throttle gear 18 and the other end attached to a portion of the throttle body 1. The torsion spring 19 biases the throttle valve 30 toward the fully closed position via the throttle gear 18 and the throttle shaft 6. A stopper (not shown) is mounted to the throttle body 1 in order to limit the rotation of the throttle gear 18. The stopper, via the throttle gear 18, eliminates the ability of the throttle valve 30 from rotating beyond a predetermined fully closed position.

As shown in FIG. 1, the motor housing portion 4 of the throttle body 1 is configured as a bottomed hollow cylindrical cavity that has a central axis parallel to the rotational axis L of the throttle shaft 6. A motor 15, such as a DC motor, is inserted into the motor housing portion 4 and is fixed in position relative to the motor housing portion 4. A motor pinion 20 is mounted to the output shaft of the motor 15. The output shaft extends in a left direction, as viewed in FIG. 1 (i.e., a direction opposite to the insertion direction of the motor 15 into the motor housing portion 4).

A countershaft 21 is mounted to the throttle body 1 in a position between the cylindrical portion 2 and the motor housing portion 4. The countershaft 21 extends parallel to the rotational axis L of the throttle shaft 6. A counter gear 22 is rotatably supported on the countershaft 21. The counter gear 22 includes a first gear portion 22*a* and a second gear portion 22*b*, each gear portion having a different outer diameter than the other gear portion. The first gear portion 22*a* has a relatively larger outer diameter and engages the motor pinion 20. The second gear portion 22*b* has a relatively smaller outer diameter and engages the throttle gear 18. The motor pinion 20, the counter gear 22, and the throttle gear 18, together constitute a speed reduction gear mechanism 23.

As shown in FIG. 1, a cover 25 is mounted to the left side of the throttle body 1 in order to cover and protect the reduction gear mechanism 23 and other associated mechanisms from exposure to the outside environment. The cover 25 may be fixed in position relative to the throttle body 1 by an appropriate mounting device, for example, such as a snap-fit device, a screw device, and a clamp device. An O-ring 26 is interposed between the throttle body 1 and the cover 25 in order to provide a hermetic seal therebetween. In this way, the cover 25 may serve as a component of the throttle body 1.

As shown in FIG. 1, a throttle sensor 28 is positioned between the throttle gear 18 and the cover 25 in order to detect the degree of opening (rotational position) of the throttle valve 30. The throttle sensor 28 may output signals corresponding to the degree of opening of the throttle valve 30.

The motor 15 may be controlled based upon signals from a control unit, such as an ECU (engine control unit), of an internal combustion engine of an automobile. The control unit may output signals to the motor 15 in order to control the degree of opening of the throttle valve 30. For example, the output signals may include an accelerator signal corresponding to the depression amount of an accelerator pedal, a traction control signal, a constant-speed travelling signal, and an idling speed control signal, among others. The rotation or the driving force of the motor 15 may be transmitted to the throttle shaft 6 via the reduction gear mechanism 23 (i.e., the motor pinion 20, the counter gear 22, and the throttle gear 18). In addition, based in part upon the following signals, signals representing the degree of opening of the throttle valve 30 detected by the throttle sensor 28 (see FIG. 1), signals representing the traveling speed of an automobile and outputted from a speed sensor (not shown), signals representing the rotational speed of the engine and outputted from a crank angle sensor (not shown), signals representing the depression amount of an accelerator pedal and outputted from an accelerator pedal sensor, signals from an $O_2$ sensor (not shown), and signals from an airflow meter (not shown) among others, the control unit, i.e., the ECU, may serve to adjust and control various parameters such as fuel injection control, correction control of the degree of opening of throttle valve 30, and variable speed control of an automatic transmission.

Figure 10:
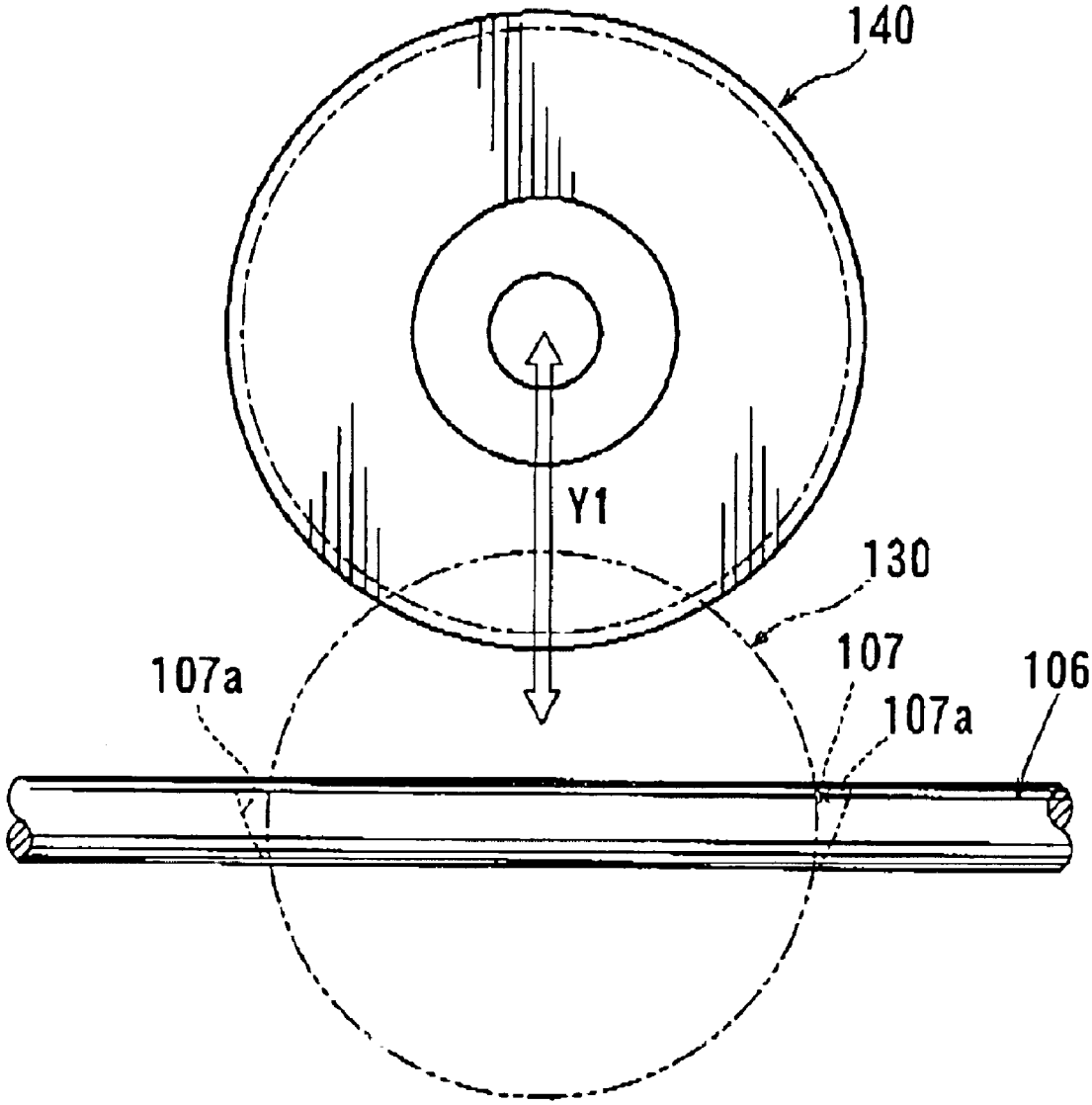
FIG. 10 is an explanatory view showing a known process for forming a slit in a throttle shaft.

The mounting structure of the throttle valve 30 to the throttle shaft 6 will now be described. A slit 7 (shown in FIG. 5) is formed in the throttle shaft 6 in a manner previously described in connection with the related art and previously shown with reference to FIG. 10. The slit 7 has end walls 7*a* spaced apart in the axial (longitudinal) direction of the throttle shaft 6 (the right and left directions as viewed in FIG. 1). The end walls 7*a* are tapered in the downward direction as viewed in FIGS. 1 and 3. Right and left mounting holes 8 are formed in the throttle shaft 6 to perpendicularly extend across the slit 7. As shown in FIG. 4, each of the mounting holes 8 includes a screw insertion hole portion 8*a* and a threaded hole portion 8*b*. The screw insertion hole portion 8*a* is formed on one side (upper side as viewed in FIG. 4) and the threaded hole portion 8*b* is formed on the other side (lower side as viewed in FIG. 4) of the throttle shaft 6. The screw insertion portion 8*a* and the threaded hole portion 8*b* are axially aligned with each other.

Figure 5:
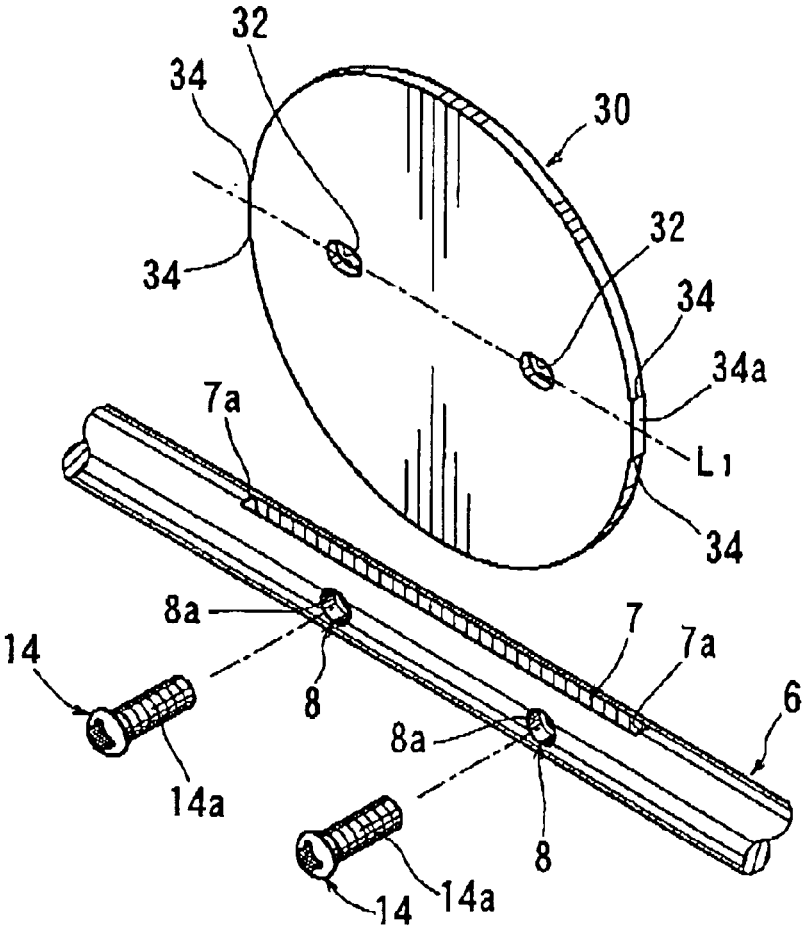
FIG. 5 is an exploded perspective view of a throttle valve and a throttle shaft.

As shown in FIG. 5, the throttle valve 30 has a substantially circular disk-shaped configuration having a predetermined diameter substantially corresponding to an inner diameter of the cylindrical bore 3. The throttle valve 30 may be formed for example by the punching operation of a flat plate material using a punching press machine. Right and left screw insertion holes 32 are formed in the throttle valve 30 in positions along a diametrical line L1 of the throttle valve 30. Once assembled, the diametrical line L1 corresponds to the rotational axis L of the throttle shaft 6. In addition, the positions of the right and left insertion holes 32 are chosen so as to be respectively aligned with the right and left mounting holes 8 of the throttle shaft 6. Preferably, each of the screw insertion holes 32 has a diameter that is greater than the diameter of the screw insertion hole portion 8*a* of the mounting hole 8. In addition, each of the screw insertion holes 32 has an approximately oval configuration that is elongated in the right and left directions.

In order to mount the throttle valve 30 to the throttle shaft 6 that has been previously mounted to the throttle body 1, the throttle shaft 6 is rotated to a position corresponding to the fully opened position of the throttle valve 30. This position causes the elongated openings of the slit 7 of the throttle shaft 6 to be oriented in a vertical direction (along the central axis of the bore 3). The throttle valve 30 is then inserted into the bore 3 from the upper side of the bore 3 as viewed in FIG. 2 and further into the slit 7 from the upper opening (see FIG. 5). Thereafter, the throttle valve 30 is rotated together with the throttle shaft 6 to a fully closed position shown in FIG. 2. As a result, the throttle valve 30 is now positioned such that the outer periphery of the throttle valve 30 extends along the inner peripheral wall of the bore 3 of the throttle body 1. In this state, threaded shanks 14*a* of the headed screws 14 are inserted into the respective screw insertion holes 32 of the throttle valve 32 via the screw insertion hole portions 8*a* of the mounting holes 8 of the throttle shaft 6. Then, the threaded shanks 14*a* are screwed into the corresponding threaded hole portions 8*b* of the mounting holes 8 and are tightened. As a result, the throttle valve 30 is clamped between opposing walls of the slit 7 of the throttle shaft 6, so as to be fixed in position relative to the throttle shaft 6.

Figure 3:
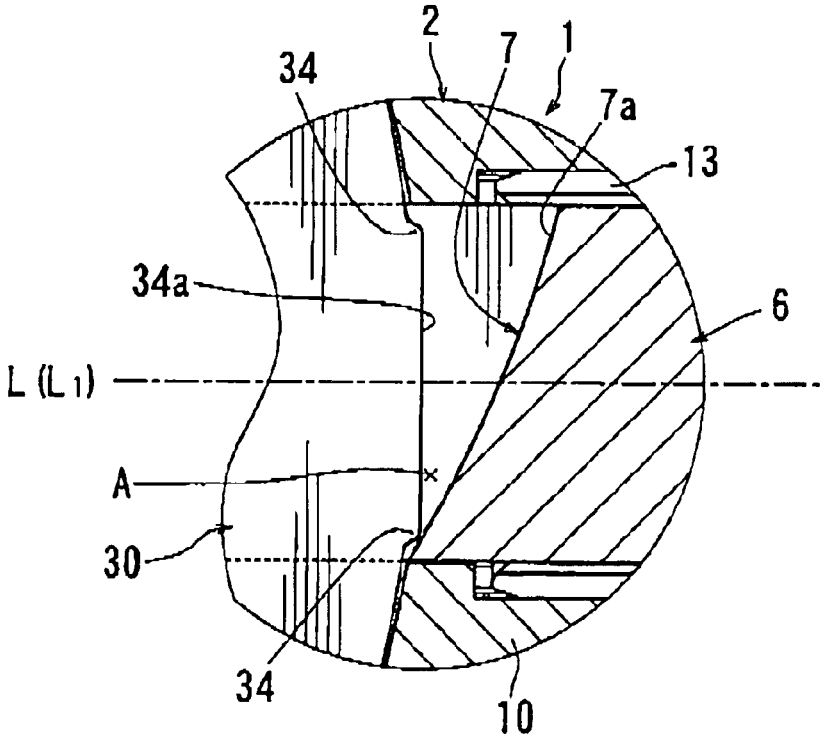
FIG. 3 is an enlarged view of a region III in FIG. 1.
Figure 4:
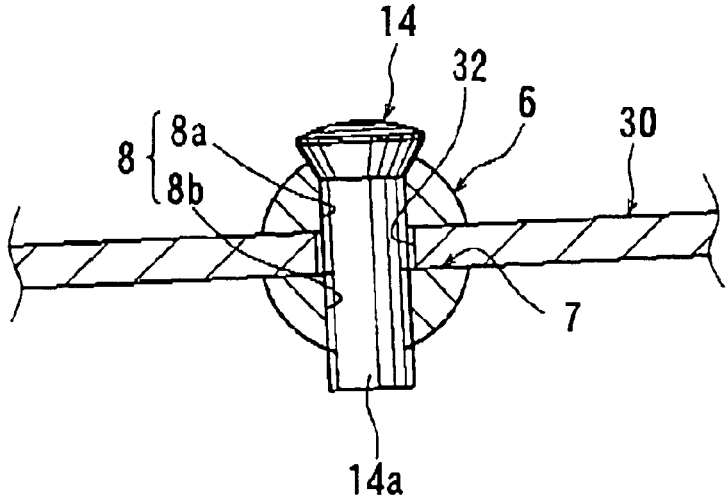
FIG. 4 is a sectional view taken along line IV—IV in FIG. 1.

As shown in FIGS. 3 and 5, right and left pairs of restriction portions 34 are formed on the outer periphery of the throttle valve 30. The right and left pairs of restrictions portions 34 are positioned symmetrically to each other with respect to the center of the throttle valve 30. As shown in FIG. 3, each pair of the restriction portions 34 extends into the channel "A". Each channel "A" is defined as the clearance between the outer periphery of the throttle valve 30 and an end wall 7*a*. The pair of restriction portions 34 narrows the channel "A" so as to reduce the sectional area of the channel "A". In addition, the restriction portions 34 in each pair have configurations symmetrical with respect to the diametrical line L1, i.e., the rotational axis L. In other words, the restriction portions 34 in each pair are symmetrical with each other about the vertical direction as viewed in FIG. 3. Further, the restriction portions 34 in each pair may be connected to each other via a linear edge 34*a* that extends perpendicular to the diametrical line L1 of the throttle valve 30. The linear edge 34*a* corresponds to a tangential line of a circle, the circle defining the majority of the outer periphery of the throttle valve 30. In this way, the restriction portions 34 in each pair are defined as corner portions of a projection that extends outward from the throttle valve 30. As shown in FIG. 3, one of the restriction portions 34 may substantially contact the end wall 7*a* or may be spaced from the end wall 7*a* by a slight distance, in either situation reliably inhibiting or reducing the possible leakage.

Preferably, the restriction portions 34 are formed at the same time that the throttle valve 30 is formed by a punching operation of a flat plate of metal. In order to prevent interference of the restriction portions 34 with the inner wall of the bore 3, the restriction portions 34 may not extend outwardly beyond the outer diameter of the throttle shaft 6.

In operation of the representative intake valve device, when the engine is started the control unit, i.e., an ECU, may output control signals to the motor 15 (see FIG. 1). The control signals may control the degree of rotation of the motor 15. As described previously, the rotational force of the motor 15 may be transmitted to the throttle valve 30 via the speed reduction mechanism 23. The throttle valve 30 is subsequently rotated to open or close the bore 3 of the throttle body 1 (see FIG. 2). The throttle sensor 28 may detect the degree of opening of the throttle valve 30.

The restriction portions 34 (preferably formed integrally with the throttle valve 30) narrow the channels "A" formed between the outer periphery of the throttle valve 30 and the end walls of the slit 7 of the throttle shaft 6. Therefore, the restriction portions 34 reduce the possible leakage of the intake air through the channels "A" when the throttle valve 30 is in a fully closed position.

In addition, the representative intake valve device is compatible with an internal combustion engine having a small air volume displacement and an internal combustion engine having a large air volume displacement. Thus, even in case of an internal combustion engine having a small air volume displacement, the restriction portions 34 may reduce the leaking intake air produced when a throttle valve is in a fully closed position. The restriction portions 34 in a small air volume displacement internal combustion engine may help to prevent or inhibit the leaking intake air from causing a substantial problem. In a range including types of the internal combustion engines described, one type having a large air volume displacement and another type having a small air volume displacement, the representative valve device may not hinder the flow of intake air supplied when a throttle valve is in a fully open position, but the representative valve device may reduce or inhibit the possible leaking of intake air when the throttle valve is in a fully closed position. Therefore, the representative valve device applied to bores having predetermined sizes can be used in a variety of internal combustion engines, where the internal combustion engines have different capacities of air volume displacement. As a result, the number of types of intake valve devices can be minimized and still cope with a variety of internal combustion engines.

Further, the representative valve device can be advantageously applied to an internal combustion engine that is configured to reduce the resistance against the suction of the intake air and that requires minimum possible leakage of the intake air.

Furthermore, according to the representative intake valve device, the restriction portions 34 in each pair are positioned symmetrically with each other with respect to the diametrical line L1 of the throttle valve 30. The diametrical line L1 is perpendicular to the direction of insertion of the throttle valve 30 into the slit 7. Therefore, it is possible to insert the throttle valve 30 into the slit 7 from the side below the throttle shaft 6 and still reduce the leakage of the intake air by the restriction portions 34. Therefore, the assembling operation of the throttle valve 30 with the throttle shaft 6 can accommodate different manufacturing orientations.

The present invention may not be limited to the representative embodiment described above but may be modified in various ways.

Figure 6:
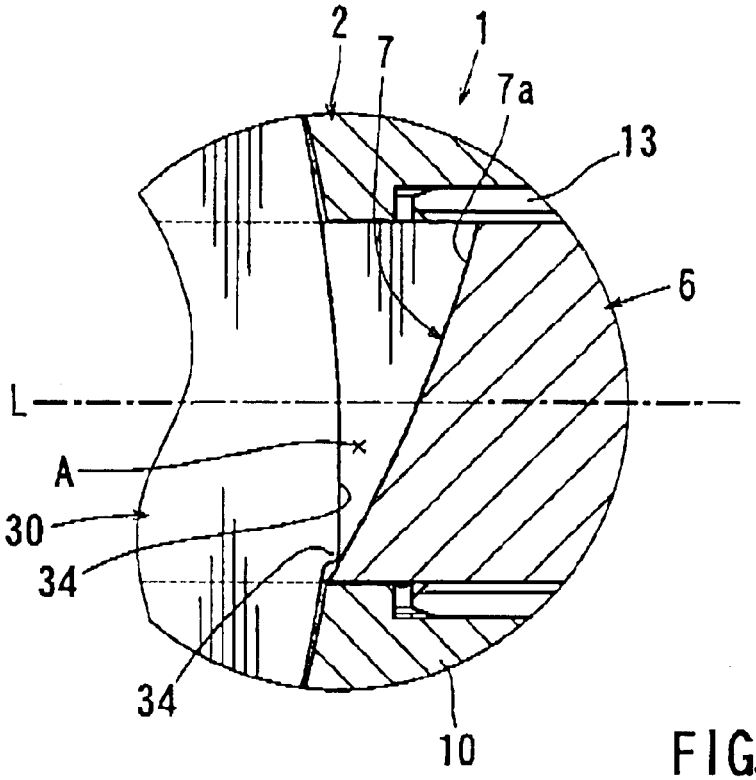
FIG. 6 is a view similar to FIG. 3, but showing an alternative embodiment.

Thus, although the restriction portions 34 are formed in a pair located on each side of the throttle plate 30, along the axial direction of the throttle shaft 6, as shown in FIG. 6, only one restriction portion 34 may be formed on each side of the throttle plate 30 in the axial direction. In the alternative embodiment shown in FIG. 6, the restriction portion 34 is formed only on the lower side (i.e., on the side that is inserted first) of the throttle valve 30. Alternatively, the restriction portion 34 may be formed only on the upper side of the throttle valve 30.

Figure 7:
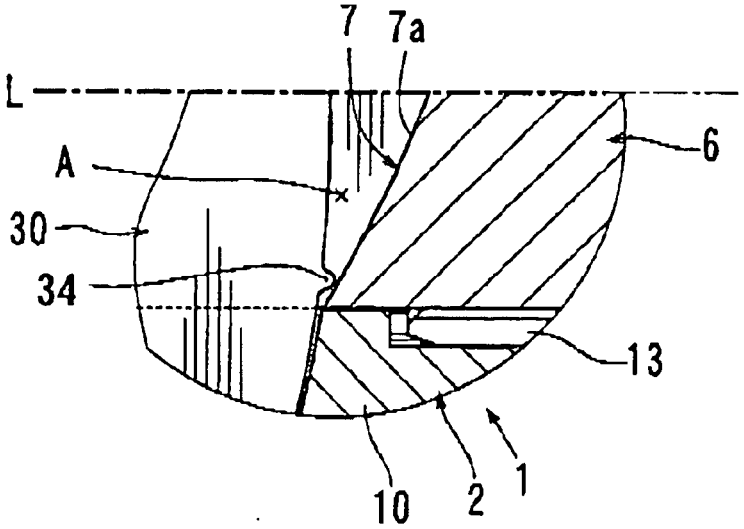
FIG. 7 is a view similar to a part of FIG. 3, but showing another alternative embodiment.
Figure 8:
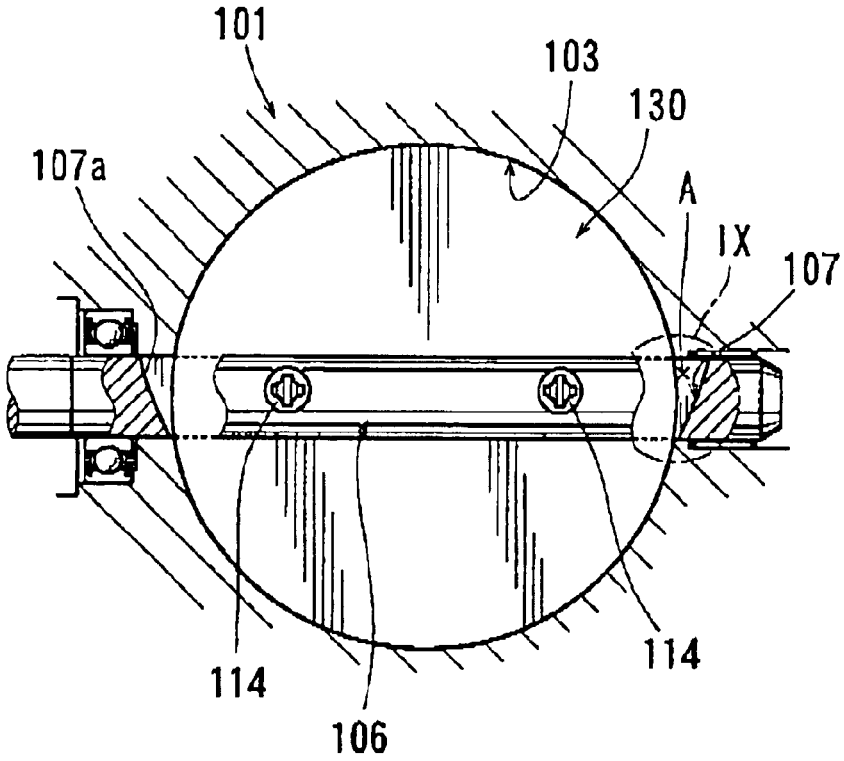
FIG. 8 is a broken-away sectional view of a known intake valve device.
Figure 9:
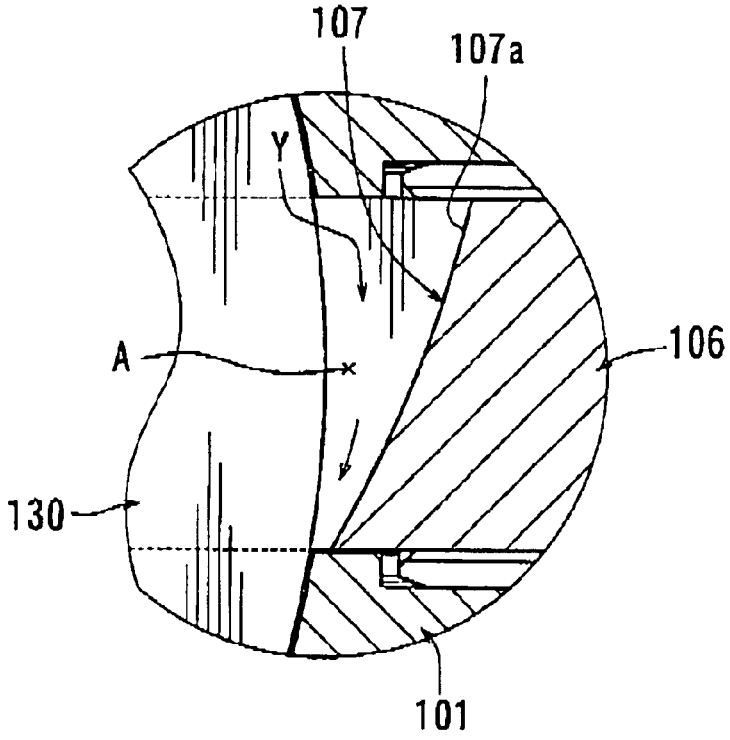
FIG. 9 is an enlarged view of a region IX in FIG. 8.

In a further alternative embodiment shown in FIG. 7, the restriction section 34 is configured as a bulge-shaped projection that extends from the outer periphery of the throttle valve 30.

Further, although the motor 15 drives the throttle valve 30 of the representative intake valve device, the throttle valve 30 may be manually driven by the operation of the acceleration pedal. In addition, the fixing device for fixing the throttle valve 30 in position relative to the throttle shaft 6 may not be limited to the screws 14. For example, the throttle valve 30 may be fixed to the throttle shaft 6 by rivets or by any known fixing techniques, such as welding and adhesion. In addition, the restriction portions 34 may have other suitable configurations than those shown in FIGS. 3, 6, and 7.

This invention claims:

1. An intake valve device comprising:

a throttle body defining a bore for the flow of intake air;

a throttle shaft having a rotational axis and rotatably mounted to the throttle body;

a slit formed in the throttle shaft in a diametrical direction and extending throughout the diameter of the throttle shaft;

wherein the slit has opposing end walls spaced apart along the rotational axis of the throttle shaft at least as wide as the bore;

a throttle valve having an outer periphery and arranged and constructed to be inserted into the slit of the throttle shaft; including at least one restriction portion; and wherein the throttle valve is fixed in position relative to the throttle shaft; and wherein a possible leakage channel is defined between the outer periphery of the throttle valve and the end wall of the slit; and wherein the at least one restriction portion extends into at least one of the possible leakage channels so as to narrow the possible leakage channel.

2. The intake valve device as in claim 1, wherein the at least one restriction portion is configured as a projection that extends from the outer periphery of the throttle valve in a direction away from the center of the throttle valve.

3. The intake valve device as in claim 2, wherein the throttle valve is inserted into the slit in a direction perpendicular to the rotational axis of the throttle shaft.

4. The intake valve device as in claim 2, wherein the at least one restriction portion is configured not to interfere with an inner wall of the bore.

5. The intake valve device as in claim 2, wherein the at least one restriction portion is configured to contact with at least a portion of the corresponding end wall of the slit.

6. The intake valve device as in claim 2, wherein the throttle valve further comprises;

a first side; and a second side; and wherein each side is defined as being directly opposite the corresponding end wall of the slit;

wherein the length of each side is approximately equal to the length of the diameter of the throttle shaft;

wherein each side is substantially centered about the rotational axis of the throttle shaft;

at least one pair of restriction portions;

wherein the pair of restriction portions is located on the side of the throttle valve.

7. The intake valve device as in claim 6, wherein the pair of restriction portions are configured to be symmetrical with each other with respect to the rotational axis of the throttle shaft when the throttle valve is fixed to the throttle shaft via a fixing device.

8. The intake valve device as in claim 7, wherein the pair of restriction portions are connected to each other via a linear edge that extends substantially perpendicular to the rotational axis of the throttle shaft.

9. An intake valve device comprising:

a throttle body defining a bore for the flow of intake air;

a throttle shaft having a rotational axis and rotatably mounted to the throttle body:

a slit extending through the center portion of the throttle shaft;

wherein the slit is open at both ends of a diameter of the throttle shaft for a region substantially as wide as the bore;

wherein the slit comprises;

a first end wall; and a second end wall;

wherein the first end wall and the second end wall are spaced apart along the rotational axis of the throttle shaft;

a throttle valve having an outer periphery and arranged and constructed to be inserted into the slit of the throttle shaft; including a first throttle valve side; and a second throttle valve side; and at least one pair of restriction portions; and wherein the throttle valve is fixed in position relative to the throttle shaft; and wherein the first throttle valve side and the second throttle valve side directly oppose the first end wall and the second end wall;

wherein a possible leakage channel is defined between directly opposing pairs of, the first throttle valve side and the second throttle valve side, and the first end wall and the second end wall; and wherein the at least one pair of restriction portions projects from one of the first throttle valve side and the second throttle valve side and extends into at least one of the possible leakage channels defined by the one of the corresponding first end wall and the second end wall; and wherein the at least one pair of restriction portions functions so as to narrow the possible leakage channel.

10. The intake valve device as in claim 9 wherein the at least one pair of restriction portions is further defined as a first pair of restriction portions and a second pair of restriction portions; and wherein one of the first pair of restriction portions and the second pair of restriction portions is on one of the first throttle valve side and the second throttle valve side; and wherein the other of the first pair of restriction portions and the second pair of restriction portions is on the other of the first throttle valve side and the second throttle valve side.

11. The intake valve device as in claim 10 wherein each pair of restriction portions is symmetrical about the rotational axis of the throttle shaft.

12. The intake valve device as in claim 11 wherein the first pair of restriction portions is joined so as to form a first line perpendicular to the rotational axis of the throttle shaft;

wherein the second pair of restriction portions is joined so as to form a second line perpendicular to the rotational axis of the throttle shaft;

wherein the length represented by the distance between the first line and the second line is not greater than the diameter length of the bore.

13. An intake valve device comprising:

a throttle body defining a bore for the flow of intake air;

a throttle shaft having a rotational axis and rotatably mounted to the throttle body:

a slit formed in the throttle shaft in a diametrical direction and extending throughout the diameter of the throttle shaft;

wherein the slit has opposing end walls spaced apart along the rotational axis of the throttle shaft at least as wide as the bore;

a throttle valve having an outer periphery and arranged and constructed to be inserted into the slit of the throttle shaft; including two or more restriction portions; and wherein the throttle valve is fixed in position relative to the throttle shaft; and wherein a possible leakage channel is defined between the outer periphery of the throttle valve and the end wall of the slit; and wherein at least one restriction portion extends into each of the possible leakage channels so as to narrow the possible leakage channel.

14. The intake valve device as in claim 13, wherein the two or more restriction portions are configured as bulges.

* * * * *